US011479050B2

(12) United States Patent
Sugiura et al.

(10) Patent No.: US 11,479,050 B2
(45) Date of Patent: Oct. 25, 2022

(54) LIQUID DISCHARGING HEAD

(71) Applicant: Brother Kogyo Kabushiki Kaisha, Nagoya (JP)

(72) Inventors: Keita Sugiura, Toyokawa (JP); Taisuke Mizuno, Yokkaichi (JP); Shotaro Kanzaki, Handa (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 17/328,728

(22) Filed: May 24, 2021

(65) Prior Publication Data

US 2021/0402791 A1 Dec. 30, 2021

(30) Foreign Application Priority Data

Jun. 29, 2020 (JP) ..... 2020-111207

(51) Int. Cl.
*B41J 2/18* (2006.01)
*B41J 2/14* (2006.01)

(52) U.S. Cl.
CPC . *B41J 2/18* (2013.01); *B41J 2/14* (2013.01); *B41J 2002/14306* (2013.01); *B41J 2002/14419* (2013.01); *B41J 2202/12* (2013.01)

(58) Field of Classification Search
CPC ..... B41J 2/18; B41J 2/14; B41J 2002/14306; B41J 2002/14419; B41J 2202/12
See application file for complete search history.

(56) References Cited

U.S. PATENT DOCUMENTS 8,480,222 B2 * 7/2013 Nishikawa ..... B41J 2/04525 347/92

FOREIGN PATENT DOCUMENTS

JP 2019-202549 A 11/2019

* cited by examiner

*Primary Examiner* — Geoffrey S Mruk
(74) *Attorney, Agent, or Firm* — Banner & Witcoff, Ltd.

(57) ABSTRACT

There is provided a liquid discharging head including: supply manifolds; a supply integration channel which extends linearly along an arrangement direction crossing a longitudinal direction of the supply manifolds; return manifolds; and a return integration channel which extends linearly along the arrangement direction. The supply integration channel has a supply port arranged apart from the supply manifolds, being configured to supply liquid to the supply integration channel via the supply port, and at least a part of the supply port being overlapped, in a plan view, with a pressure chamber-arranging area in which pressure chambers communicating with nozzles are arranged. The return integration channel has a return port arranged apart from the return manifolds, being configured to drain the liquid from the return integration channel via the return port, and at least a part of the return port being overlapped, in the plan view, with the pressure chamber-arranging area.

8 Claims, 6 Drawing Sheets

LIQUID DISCHARGING HEAD

CROSS REFERENCE TO RELATED APPLICATION

The present application claims priority from Japanese Patent Application No. 2020-111207, filed on Jun. 29, 2020, the disclosure of which is incorporated herein by reference in its entirety.

BACKGROUND

The present disclosure relates to a liquid discharging head (liquid discharge head).

Japanese Patent Application Laid-open No. 2019-202549 discloses a liquid discharging head provided with a first integration channel, a first common channel, individual channels, a second common channel, and a second integration channel. In this liquid discharging head, the first integration channel is arranged at the outside of a pressurizing chamber-arranging area (at the outside in a first direction), and the second integration channel is arranged at the outside of the pressurizing chamber-arranging area (at the outside in a third direction). Further, an opening of the first integration channel is arranged at the outside of the pressurizing chamber-arranging area (a first extending part of the first integration channel) in a second direction, and an opening of the second integration channel is arranged at the outside of the pressurizing chamber-arranging area (a second extending part of the second integration channel) in a fourth direction. In such a configuration, for example, a liquid such as an ink, etc., is allowed to flow in an order of: the first integration channel, the first common channel, the individual channels, the second common channel and the second integration channel.

SUMMARY

According to an aspect of the present disclosure, there is provided a liquid discharging head including:

a plurality of supply manifolds which is configured to receive a liquid to be discharged from a plurality of nozzles, and which is arranged side by side with each other;

a supply integration channel which extends linearly along an arrangement direction crossing a longitudinal direction of the plurality of supply manifolds, and which is configured to supply the liquid to each of the plurality of supply manifolds;

a plurality of return manifolds which extends in the longitudinal direction of the plurality of supply manifolds, and which is configured to receive the liquid not having been discharged from the plurality of nozzles; and a return integration channel which extends linearly along the arrangement direction, and which is configured to receive the liquid from each of the plurality of return manifolds, wherein the supply integration channel has a supply port arranged, apart from each of the plurality of supply manifolds, at an upper side of the supply integration channel, the supply port being configured to supply the liquid to the supply integration channel via the supply port, and at least a part of the supply port being overlapped, in a plan view, with a pressure chamber-arranging area as an area in which each of a plurality of pressure chambers communicating with each of the plurality of nozzles is arranged; and the return integration channel has a return port arranged, apart from each of the plurality of return manifolds, at an upper side of the return integration channel, the return port being configured to drain the liquid from the return integration channel via the return port, and at least a part of the return port being overlapped, in the plan view, with the pressure chamber-arranging area.

DESCRIPTION

In the recent year, since there is a demand for a liquid discharging head for which miniaturization thereof is pursued, the above-described conventional liquid discharging head still has a room for further improvement so as to satisfy such a demand.

In view of the above-described situation, an object of the present disclosure is to provide a liquid discharging head which is miniaturized than the conventional counterparts.

According to the present disclosure, at least a part of the supply port of the supply integration channel is arranged on the inner side of the pressure chamber-arranging area, and at least a part of the return port of the return integration channel is arranged on the inner side of the pressure chamber-arranging area. With this, it is possible to miniaturize the liquid discharging head both in the arrangement direction and the head longitudinal direction which is the direction crossing the arrangement direction. Further, since each of the supply integration channel and the return integration channel extends in the arrangement direction in the non-bent state (linearly, straightly), it is possible to make the length (channel length) of each of the supply integration channel and the return integration channel to be short, thereby making it possible to lower the channel resistance of each of the supply integration channel and the return integration channel. Furthermore, also in a case that a line head is formed by arranging a plurality of pieces of the head in a width direction of a recording medium, it is possible to miniaturize the liquid discharging head as described above also in a conveying direction of the recording medium, thereby making it possible to lower any disturbance in printing due to any error in conveyance.

According to the present disclosure, it is possible to provide a liquid discharging head miniaturized further as compared with the conventional liquid discharging head.

In the following, a liquid discharging head according to an embodiment of the present invention will be explained, with reference to the drawings. The liquid discharging head to be explained below is merely an embodiment of the present invention. Therefore, the present invention is not limited to or restricted by the following embodiment; it is allowable to make any addition, deletion and change to the present disclosure, within the range not departing from the gist and spirit of the present invention.

First Embodiment

A liquid discharging apparatus 200 provided with a liquid discharging head 100 according to the present embodiment is configured, for example, to discharge (eject) a liquid such as an ink, etc.

Figure 1:
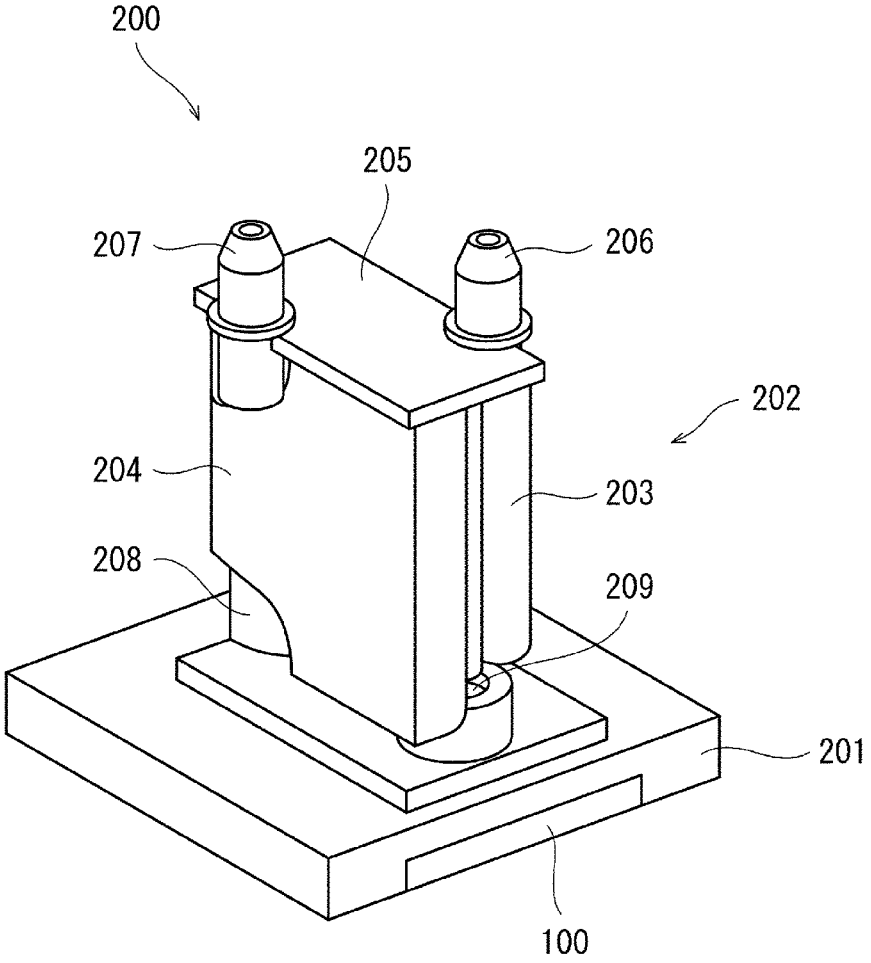
FIG. 1 is a perspective view depicting the outer appearance of a liquid discharging apparatus provided with a liquid discharging head according to a first embodiment of the present disclosure.

As depicted in FIG. 1, the liquid discharging apparatus 200 of the present embodiment is provided with a head installing part 201 and a housing 202 provided on the head installing part 201. The liquid discharging head 100, which is to be described later on, is installed in the head installing part 201.

The housing 202 has sub housings 203 and 204. Upper parts of the sub housings 203 and 204 are connected to a supporting structure 205, thereby allowing the sub housings 203 and 204 to be fixed, while facing each other. Each of the sub housings 203 and 204 is formed, for example, to have a thin box shape.

The sub housing 204 has a liquid inlet port 207 at an upper part thereof, and a liquid outlet port 208 at a lower part thereof. The liquid inflowed into the sub housing 204 from the liquid inlet port 207 is filtered in the sub housing 204, and is then fed from the liquid outlet port 208 to a channel inside the head installing part 201 (a channel connecting or linking to the liquid discharging head 100).

On the other hand, the sub housing 203 has a liquid outlet port 206 at an upper part thereof, and a liquid inlet port 209 at a lower part thereof. The liquid fed out from the channel inside the head installing part 201 enters from the liquid inlet port 209 into the inside of the sub housing 203. Then, the liquid is filtered in the sub housing 203, and is then returned to the liquid inlet port 207, from the liquid outlet port 206, by a pressure of a non-illustrated pump provided between the liquid outlet port 206 and the liquid inlet port 207, thereby allowing the liquid to be circulated.

Figure 2:
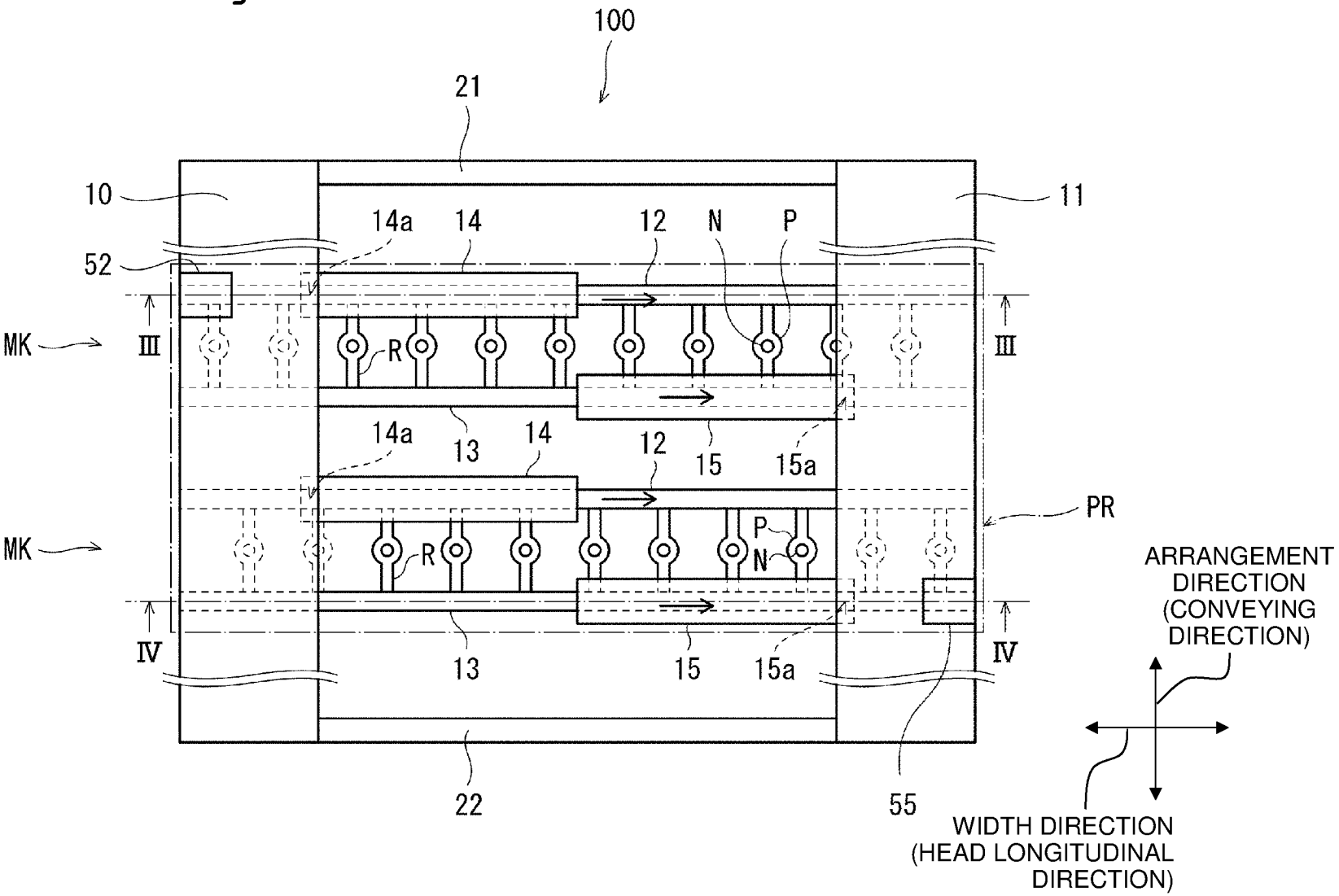
FIG. 2 is a plan view depicting the liquid discharging head according to the first embodiment.

In the following, the liquid discharging head 100 of the present embodiment will be specifically explained. FIG. 2 is a plan view depicting the liquid discharging head 100. Note that FIG. 2 depicts only the channel for the liquid, and illustration of parts or portions forming the channel are omitted in FIG. 2.

The liquid discharging head 100 of the present embodiment is provided with a supply integration channel 10, a return integration channel 11, a plurality of supply manifolds 12, a plurality of return manifolds 13, a plurality of interposer channels 14 (corresponding to a "connecting channel"), and a plurality of interposer channels 15 (corresponding to a "connecting channel").

In a state that the supply integration channel 10 and the return integration channel 11 are apart or separated from each other in a width direction (namely, a head longitudinal direction; in the present specification, this width direction is also referred to as a "left-right direction"; in this case, a side of the supply integration channel 10 is referred to as the left side, and a side of the return integration channel 11 is referred to as the right side"), each of the supply integration channel 10 and the return integration channel 11 extends in an arrangement direction which is orthogonal to the width direction (namely, a conveying direction of a recording medium; in the present specification, this arrangement direction is also referred to as a "front-rear direction"; in this case, a side of a supply port 52 (to be described later on) is referred to as the rear side, and a side of a return port 55 (to be described later on) is referred to as the front side). The supply integration channel 10 is arranged on the side of the left end (corresponding to the "side of one end", the same shall apply hereafter) in the width direction. In contrast to this, the return integration channel 11 is arranged on the side of the right end (corresponding to the "side of the other end", the same shall apply hereafter) in the width direction. The supply integration channel 10 and the return integration channel 11 allow, for example, a liquid such as an ink, etc., to flow therethrough.

The supply integration channel 10 supplies the liquid to each of the plurality of supply manifolds 12. Such a supply integration channel 10 has a shape extending in the arrangement direction in a non-bent state. Further, as depicted in FIG. 2, the supply integration channel 10 has a supply port 52 which is an opening on the upper side of and apart or separate from each of the plurality of supply manifolds 12, and to which the liquid is supplied. The supply port 52 is arranged on the left end in the width direction of the plurality of supply manifolds 12. Furthermore, at least a part of the supply port 52 overlaps, in the plan view (that is, when seen in a stacking direction (described below) from the upper side), with the inner side (inside) of a pressure chamber-arranging area PR as an area wherein a plurality of pressure chambers P each of which communicates with one of the plurality of nozzles N are arranged, as will be described later on. More specifically, the supply port 52 is arranged so that the entirety of the supply port 52 overlaps with the inner side of the pressure chamber-arranging area PR in the plan view. In the present embodiment, the pressure chamber-arranging area PR is an area in which the respective pressure chambers P are arranged, as described above, and is a rectangular area which is constructed of sides along the width direction and sides along the arrangement direction. Specifically, as depicted in a frame of one-dot-chain lines in FIG. 2, the pressure chamber-arranging area PR is an area including a rear-most supply manifold 12 in the arrangement direction which are included in the plurality of supply manifolds 12 and a front-most return manifold 13 in the arrangement direction which are included in the plurality of return manifolds 13. In the embodiment, the front side of the pressure chamber-arranging area PR is defined by the front edge of the front-most return manifold 13; the rear side of the pressure chamber-arranging area PR is defined by the rear edge of the rear-most supply manifold 12; the left side of the pressure chamber-arranging area PR is defined by the left ends of the supply manifolds 12 and the return manifolds 13; and the right side of the pressure chamber-arranging area PR is defined by the right ends of the supply manifolds 12 and the return manifolds 13. Note that a specific explanation of the cross-sectional structure including the supply integration channel 10 and corresponding to FIG. 2 will be given later.

The liquid from each of the plurality of return manifolds 13 flows into the return integration channel 11. Such a return integration channel 11 has a shape extending in the arrangement direction in a non-bent state. Further, as depicted in FIG. 2, the return integration channel 11 has a return port 55 which is an opening on the upper side of and apart from each of the plurality of return manifolds 13, and from which the liquid flows out. The return port 55 is arranged on the right end in the width direction of the plurality of return manifolds 13. Furthermore, at least a part of the return port 55 overlaps, in the plan view, with the inner side of the pressure chamber-arranging area PR. More specifically, the return port 55 is arranged so that the entirety of the return port 55 overlaps with the inner side of the pressure chamber-arranging area PR in the plan view. The return port 55 and the supply port 52 as descried above are apart from each other in the arrangement direction. Note that a specific explanation of the cross-sectional structure including the return integration channel 11 and corresponding to FIG. 2 will be given later.

The plurality of supply manifolds 12 and the plurality of return manifolds 13 are provided alternately in the arrangement direction. In the example depicted in FIG. 2, one supply manifold 12 among the plurality of supply manifolds 12 and one return manifolds 13 among the plurality of return manifolds 13 are arranged in this order. In the following, for the sake of convenience of the explanation, a combination of the one supply manifold 12 and the one return manifold 13 are referred to as a supply-return combination MK. Such a supply-return combination MK is provided as a plurality of supply-return combinations MK along the arrangement direction. In FIG. 2, two pieces of the supply-return combination MK which are provided along the arrangement direction are depicted. A spacing distance between one supply-return combination MK and another supply-return combination MK which are adjacent to each other in the arrangement direction is, for example, constant. That is, a plurality of pieces of the supply-return combination MK are arranged in the arrangement direction, for example, at equal intervals. Further, a spacing distance between the supply manifold 12 and the return manifold 13 in each of the supply-return combinations MK is, for example, constant among a plurality of pieces of the supply-return combination MK.

A liquid, which is to be discharged from the plurality of nozzles N (to be described later on) is supplied to each of the plurality of supply manifolds 12. Further, the liquid which has not been discharged from the plurality of nozzles N is made to return to each of the plurality of return manifolds 13. Each of the plurality of supply manifolds 12 and the plurality of return manifolds 13 as described above extends in the width direction. Thus, the width direction is an extending direction (longitudinal direction) of the supply manifold 12 and the return manifold 13. An upstream end (left end) of each of the plurality of supply manifolds 12 is arranged, in the width direction, within the supply integration channel 10, and a downstream end (right end) of each of the plurality of supply manifolds 12 is arranged, in the width direction, within the return integration channel 11. Similarly, an upstream end (left end) of each of the plurality of return manifolds 13 is arranged, in the width direction, within the supply integration channel 10, and a downstream end (right end) of each of the plurality of return manifolds 13 is arranged, in the width direction, within the return integration channel 11.

The interposer channel 14 is a component for the supply-return combination MK. A channel width of the interposer channel 14 is, for example, greater than a channel width of the supply manifolds 12. The interposer channel 14 connects (links) a supply manifold 12 and the supply integration channel 10. The connecting or liking structure between the supply manifold 12 and the supply integration channel 10 by the interposer channel 14 will be described later on with a cross-sectional view. The interposer channel 14 has an interposer channel-inlet port 14*a* (corresponding to a "connection channel-inlet") which is an opening arranged at a lower side of the supply integration channel 10. The interposer channel-inlet port 14*a* is arranged at the side of a left end of a central part in the width direction of the supply manifold 12. In such a configuration, the liquid from the supply integration channel 10 is allowed to flow into the supply manifold 12 via the interposer channel-inlet port 14*a* of the interposer channel 14.

The interposer channel 15 is a component for the supply-return combination MK. A channel width of the interposer channel 15 is, for example, greater than a channel width of the return manifold 13. The interposer channel 15 connects or links a return manifold 13 and the return integration channel 11. The connecting or liking structure between the return manifold 13 and the return integration channel 11 by the interposer channel 15 will be described later on with a cross-sectional view. The interposer channel 15 has an outlet port 15*a* which is arranged at the side of a right end of the central part in the width direction of the return manifold 13. In such a configuration, the liquid from the return manifold 13 is allowed to flow into the return integration channel 11 via the interposer channel 15.

Channel resistance in the interposer channel 15 is made to be substantially same as channel resistance in the interposer channel 14. The term "channel resistance" indicates easiness of the flow of liquid in a channel, and is a value of resistance in the channel, in other words, a value obtained by integrating a value of resistance per a unit length of the channel, along a channel length of the channel. In the present embodiment, the channel length of the interposer channel 14 is substantially same as the channel length of the interposer channel 15. Further, a channel cross-sectional area of the interposer channel 14 is substantially same as a channel cross-sectional area of the interposer channel 15.

A plurality of individual channels R connecting the supply manifold 12 and the return manifold 13 are provided on each of the plurality of supply-return combinations MK. Each of the plurality of individual channels R extends in the arrangement direction between the supply manifold 12 and the return manifold 13. The plurality of individual channels R are arranged side by side in the width direction at a substantially equal spacing distance therebetween. A pressure chamber P and a nozzle N which has, for example, a circular shape in a plan view are connected to an intermediate part of each of the above-described plurality of individual channels R. A plurality of pieces of the nozzle N are arranged side by side in the width direction. Each of the plurality of nozzles N discharges the liquid.

The liquid discharging head 100 of the present embodiment is provided with a first bypass channel 21 and a second bypass channel 22. The first bypass channel 21 extends in the width direction, and connects or links an end of the supply integration channel 10 and an end of the return integration channel 11. The second bypass channel 22 extends in the width direction, and connects or links the other end of the supply integration channel 10 and the other end of the return integration channel 11.

In the supply-return combination MK as explained above, the liquid flowing through the supply integration channel 10 flows into the supply manifold 12 via the interposer channel-inlet port 14*a* of the interposer channel 14. After that, the liquid inside the supply manifold 12 flows leftward and rightward in the width direction of the supply manifold 12 and flows into each of the plurality of individual channels R, and is discharged from the nozzle N. On the other hand, the liquid which has not been discharged from the nozzle N is allowed to flow into the return integration channel 11 via the return manifold 13 and the interposer channel 15.

Next, the configuration of the cross-section of the liquid discharging head 100 of the present embodiment will be explained, with reference to the drawings.

Figure 3:
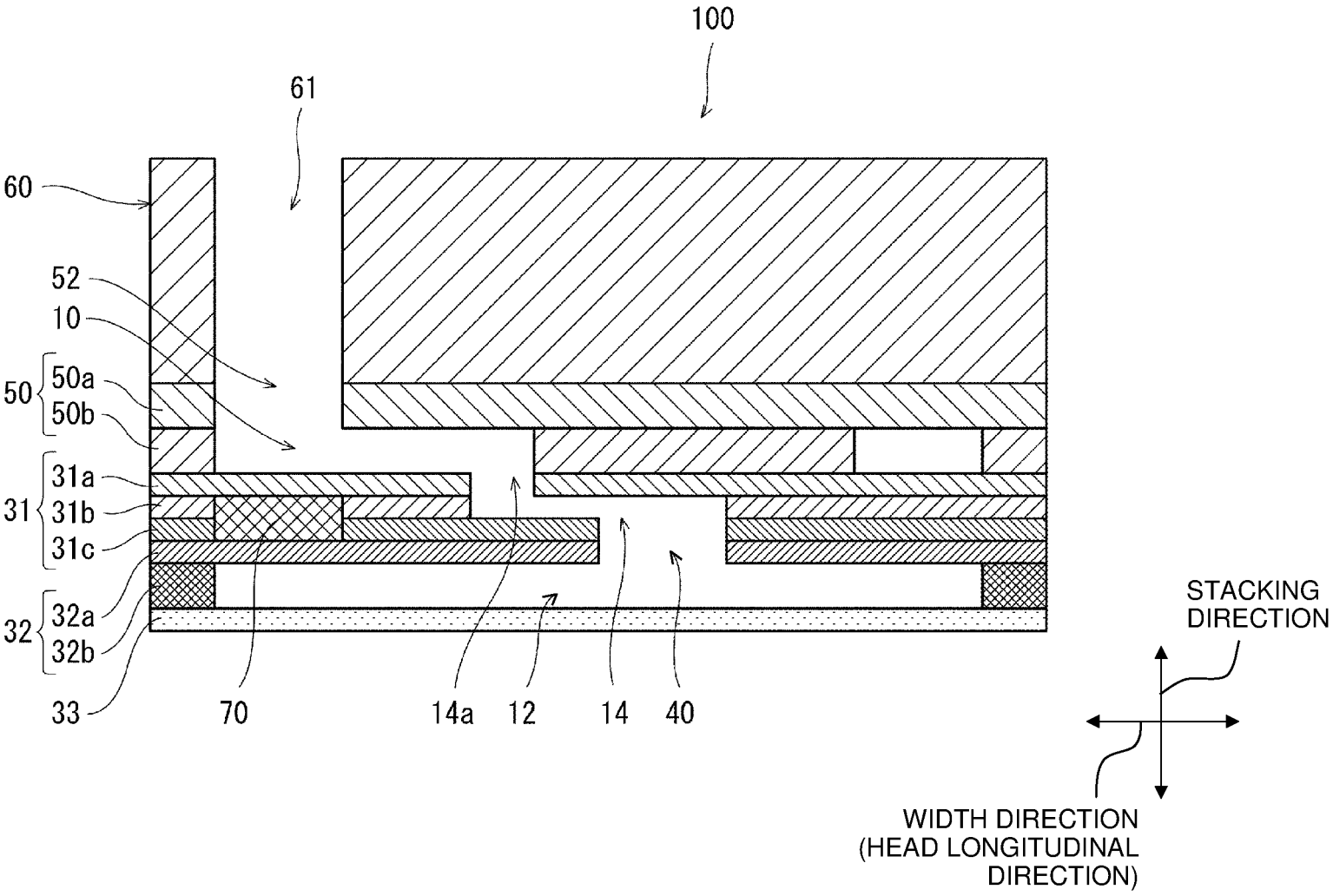
FIG. 3 is a cross-sectional view taken along a line in FIG. 2.

FIG. 3 is a cross-sectional view taken along a line in FIG. 2. As depicted in FIG. 3, the liquid discharging head 100 includes a stacked body formed of a plurality of plates. Specifically, the liquid discharging head 100 includes a sub housing plate 60, a reservoir plate 50, an interposer plate 31, a manifold plate 32, and a nozzle plate 33. Note that the nozzle plate 33, the manifold plate 32, the interposer plate 31, the reservoir plate 50 and the sub housing plate 60 are stacked in this order.

The nozzles N are formed to penetrate through the nozzle plate 33 in a stacking direction (in the present specification, the stacking direction is referred to as an "up-down direction", as well; in this case, a side of the nozzle plate 33 is referred to as the lower side (downside), and a side of the sub housing plate 60 is referred to as the upper side (topside)). Note that although each of the nozzles N is formed by one plate which is the nozzle plate 33, each of the nozzles N may be formed by two or more plates.

Further, the manifold plate 32 includes a first channel plate 32*a* and a second channel plate 32*b*. The supply manifold 12 is formed by penetrating through the second channel plate 32*b* in the stacking direction. The supply manifold 12 is arranged so that a center in the width direction of the second channel plate 32*b* is substantially coincide (matches) with a center in the width direction of the supply manifold 12. As described above, the supply manifold 12 extends in the width direction, and the supply manifold 12 communicates with the respective nozzles N via the respective individual channels R. Note that although the supply manifold 12 is formed by one plate which is the second channel plate 32*b*, the supply manifold 12 may be formed by two or more plates.

Further, a connecting channel 40 is formed by penetrating through the first channel plate 32*a* in the stacking direction. The connecting channel 40 connects or links the upstream end of the supply manifold 12 and the downstream end of the interposer channel 14. The connecting channel 40 is arranged on the right side in the width direction of the supply manifold 12, with respect to the center in the width direction of the supply manifold 12.

The interposer plate 31 includes a third channel plate 31*a*, a fourth channel plate 31*b* and a fifth channel plate 31*c* each of which has a through hole formed therein. The interposer channel 14 is constructed by combining the through holes formed in the third channel plate 31*a*, the fourth channel plate 31*b* and the fifth channel plate 31*c*, respectively. Specifically, the through hole in the third channel plate 31*a* is formed at a location below the supply integration channel 10. The size of the through hole in the third channel plate 31*a* is smaller than the width of the supply integration channel 10. Further, the through hole in the fourth channel plate 31*b* is constructed of a first part formed below the through hole in the third channel plate 31*a*, and a second part which is formed on the right side of the first part. Furthermore, the through hole in the fifth channel plate 31*c* is arranged between the second part and the above-described connecting channel 40. The size of the through hole in the fifth channel plate 31*c* is same as the width of the second part in the fourth channel plate 31*b*. Such through holes are combined to thereby form, for example, an interposer channel 14 having a stepped shape. Note that an IC chip 70 which drives the liquid discharging head 100 is provided in the fourth channel plate 31*b* and the fifth channel plate 31*c*, at a location below the supply integration channel 10.

The reservoir plate 50 includes a sixth channel plate 50*a* and a seventh channel plate 50*b* each of which has a through hole formed therein. The supply integration channel 10 is constructed by combining the through holes formed in the sixth channel plate 50*a* and the seventh channel plate 50*b*, respectively. Specifically, an opening on the upper side in the through hole in the sixth channel plate 50*a* becomes to be the above-described supply port 52. As described above, the entirety of the supply port 52 is arranged so as to overlap with the inner side of the pressure chamber-arranging area PR. As depicted in FIG. 3, the supply port 52 is arranged to be separated with respect to the interposer channel-inlet port 14*a*. In particular, in the present embodiment, the supply port 52 is arranged on the outer side in the width direction of the supply manifold 12, with respect to the interposer channel-inlet port 14*a*.

Further, the through hole in the seventh channel plate 50*b* is constructed of a first part formed below the through hole in the sixth channel plate 50*a*, and a second part which is formed on the right side of the first part. Furthermore, the width of the first part in the seventh channel plate 50*b* is substantially same as the width of the through hole in the sixth channel plate 50*a*. Such first and second parts in the seventh channel plate 50*b* and the through hole in the sixth channel plate 50*a* are combined to thereby form the supply integration channel 10.

A through hole 61 is formed in the sub housing plate 60. The through hole 61 is located at a position above the through hole, in the sixth channel plate 50*a*, which constructs a part of the supply integration channel 10. Accordingly, the through hole 61 in the sub housing plate 60 is connected to the inlet port 52 of the supply integration channel 10. Further, the width of the through hole 61 is substantially same as the width of the through hole in the sixth channel plate 50*a*.

In such a configuration, although the following explanation overlaps partially with the foregoing description, the flow of the liquid in the supplying system in the liquid discharging apparatus 100 of the present embodiment will be explained. Firstly, the liquid flows from the through hole 61 in the sub housing plate 60 into the supply integration channel 10 via the supply port 52. Then, the liquid flowed through the supply integration channel 10 flows into the interposer channel 14 via the interposer channel-inlet port 14*a*. Subsequently, the liquid in the inside of the interposer channel 14 flows into the supply manifold 12 via the connecting channel 40. Afterwards, the liquid in the inside of the supply manifold 12 flows into the plurality of individual channels R, and is discharged from the plurality of nozzles N.

Figure 4:
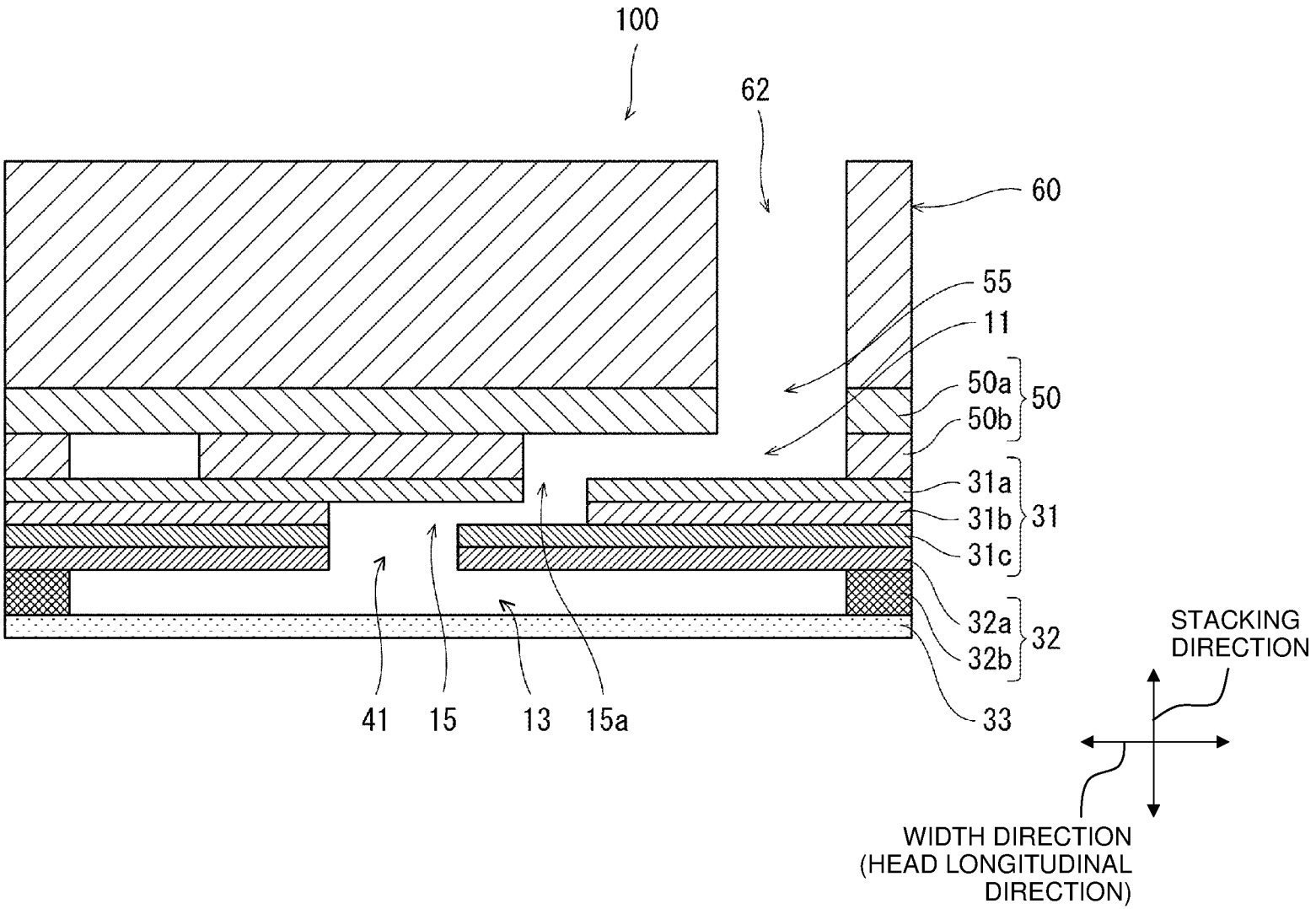
FIG. 4 is cross-sectional view taken along a IV-IV line in FIG. 2.

Next, FIG. 4 is cross-sectional view taken along a IV-IV line in FIG. 2. The cross-sectional view in FIG. 4 is bilaterally symmetric with respect to the above-described cross-sectional view of FIG. 3. In the following, any explanation regarding a part overlapping with the content explained with respect to FIG. 3 will be omitted, and only a content different from that in FIG. 3 will be explained.

As depicted in FIG. 4, a part, of the second channel plate 32*b* included in the manifold plate 32, which is different from the supply manifold 12 is penetrated in the stacking direction to thereby form the return manifold 13. The return manifold 13 is arranged so that a center in the width direction of the second channel plate 32*b* is substantially coincide (matches) with a center in the width direction of the return manifold 13. As described above, the return manifold 13 extends in the width direction, and communicates with the respective nozzles N via the respective individual channels R.

In the present embodiment, the cross-sectional area of the return manifold 13 is substantially same as the cross-sectional area of the supply manifold 12. For example, it is allowable that the supply manifold 12 and the return manifold 13 have sizes and shapes each of which are same as each other. In such a case, it is allowable that the supply manifold 12 and the return manifold 13 have mutually same sizes in the arrangement direction, the width direction, and the stacking direction, respectively.

Further, a connecting channel 41 is formed by penetrating through a part, of the first channel plate 32*a*, which is different from the above-described connecting channel 40 in the stacking direction. The connecting channel 41 connects or links the downstream end of the return manifold 13 and the upstream end of the interposer channel 15. The connecting channel 41 is arranged on the left side in the width direction of the return manifold 13, with respect to a center in the width direction of the return manifold 13.

The interposer channel 15 is constructed by combining through holes which are formed in the third channel plate 31*a*, the fourth channel plate 31*b* and the fifth channel plate 31*c*, respectively, and which are different from the above-described through holes formed in the third channel plate 31*a*, the fourth channel plate 31*b* and the fifth channel plate 31*c*, respectively. Specifically, the through hole in the third channel plate 31*a* is formed at a location below the return integration channel 11. The size of the through hole in the third channel plate 31*a* is smaller than the width of the return integration channel 11. Further, the through hole in the fourth channel plate 31*b* is constructed of a first part formed below the through hole in the third channel plate 31*a*, and a second part which is formed on the left side of the first part. Furthermore, the through hole in the fifth channel plate 31*c* is arranged between the second part and the above-described connecting channel 41. The size of the through hole in the fifth channel plate 31*c* is same as the width of the second part. Such through holes are combined to thereby form, for example, an interposer channel 15 having a stepped shape.

The return integration channel 11 is constructed by combining through holes formed in the sixth channel plate 50*a* and the seventh channel plate 50*b*, respectively, which are different from the above-described through holes formed in the sixth channel plate 50*a* and the seventh channel plate 50*b*, respectively. Specifically, an opening on the upper side in the through hole in the sixth channel plate 50*a* becomes to be the above-described return port 55. As described above, the entirety of the return port 55 is arranged so as to overlap with the inner side of the pressure chamber-arranging area PR. As depicted in FIG. 4, the return port 55 is arranged to be separated with respect to the outlet port 15*a* of the interposer channel 15. In particular, in the present embodiment, the return port 55 is arranged on the outer side in the width direction of the return manifold 13, with respect to the outlet port 15*a* of the interposer channel 15.

Further, the through hole in the seventh channel plate 50*b* is constructed of a first part formed below the through hole in the sixth channel plate 50*a*, and a second part which is formed on the left side of the first part. Furthermore, the width of the first part in the seventh channel plate 50*b* is substantially same as the width of the through hole in the sixth channel plate 50*a*. Such first and second parts in the seventh channel plate 50*b* and the through hole in the sixth channel plate 50*a* are combined to thereby form the return integration channel 11.

A through hole 62, which is different from the through hole 61 as described above, is formed in the sub housing plate 60. The through hole 62 is located at a position above the through hole, in the sixth channel plate 50*a*, which constructs a part of the return integration channel 11. Accordingly, the through hole 62 in the sub housing plate 60 is connected to the return port 55 of the return integration channel 11. Further, the width of the through hole 62 is substantially same as the width of the through hole in the sixth channel plate 50*a*.

In such a configuration, the liquid which has not been discharged from the nozzle N is allowed to flow in the inside of the return manifold 13 and then to flow into the interposer channel 15 via the connecting channel 41. Then, the liquid flows in the inside of the interposer channel 15 and then is allowed to flow into the return integration channel 11 via the outlet port 15*a* of the interposer channel 15.

As explained above, in the liquid discharging head 100 of the present embodiment, at least a part of the supply port 52 of the supply integration channel 10 is arranged, in the plan view, on the inner side of the pressure chamber-arranging area PR, and at least a part of the return port 55 of the return integration channel 11 is arranged, in the plan view, on the inner side of the pressure chamber-arranging area PR. With this, it is possible to miniaturize the liquid discharging head 100 in both of the arrangement direction and the width direction which is a direction crossing the arrangement direction. Further, since each of the supply integration channel 10 and the return integration channel 11 extends in the arrangement direction in the non-bent state, it is possible to shorten the channel length of each of the supply integration channel 10 and the return integration channel 11, and thus to lower the channel resistance in each of the supply integration channel 10 and the return integration channel 11. Further, since the liquid discharging head 100 can be miniaturized also in the conveying direction as described above, it is possible to lower any disturbance in printing due to any error in conveyance further as compared with the conventional liquid discharging head.

Further, in the present embodiment, the supply port 52 is arranged at a rear end part in the arrangement direction of the supply integration channel 10, and the return port 55 is arranged at a front end part in the arrangement direction of the return integration channel 11. With such a configuration, it is possible to make the channel resistance since the liquid flows from the supply port 52 into any one of the plurality of individual channels R and until the liquid flows into the return port 55 to be same among the plurality of individual channels R. With this, it is possible to make the liquid to flow easily in the entire liquid discharging head 100. Note that it is allowable to arrange the supply port 52 at a central part of the supply integration channel 10 in the longitudinal direction of the supply integration channel 10 (i.e., arrangement direction), and to arrange the return port 55 at a central part of the return integration channel 11 in the longitudinal direction of the return integration channel 11 (i.e., arrangement direction).

Furthermore, in the present embodiment, the supply port 52 is configured so that the supply port 52 is separated in the width direction with respect to the interposer channel-inlet port 14*a*, in the plan view. With this, the liquid supplied to the supply port 52 is allowed to flow in the supply integration channel 10 and to make contact with (abuts against) the upper surface of the third channel plate 31*a* of the interposer plate 31, and then to flow into the interposer channel 14 from the interposer channel-inlet port 14*a*. With this, it is possible to promote the liquid supplied to the supply port 52 to flow to the supply integration channel 10, and to make rectify the liquid flowing in the channel on the downstream side of the supply integration channel 10. With this, it is possible to introduce the liquid appropriately to the channel on the downstream side of the supply integration channel 10.

Moreover, in the present embodiment, the IC chip 70 is provided at the location below the supply integration port 10 (supply port 52), and the supply port 52 is arranged, in the plan view, on the outer side in the width direction of the supply manifold 12, with respect to the interposer channel-inlet port 14*a*. Owing to such a configuration, the heat of the IC chip 70 can be taken by the liquid from the inlet port 52 via the third channel plate 31*a* of the interposer plate 31. With this, it is possible to cool the IC chip 70.

Further, the present embodiment has the configuration wherein the supply port 52 and the return port 55 are separated from each other in the arrangement direction and the width direction. Accordingly, in a case that a supplying joint (a connecting member to which a downstream end of a supplying tube, which has an upstream end thereof connected to a sub tank storing the liquid, is connected) and a returning joint (a connecting member to which an upstream end of a returning tube, which has a downstream end thereof connected to the sub tank, is connected) are arranged, the supplying joint and the returning joint are less likely to interfere with each other. With this, the above-described configuration contributes to the miniaturization of the liquid discharging head 100.

Further, in the present embodiment, the first bypass channel 21 and the second bypass channel 22 are provided. With this, the flow rate of the liquid in each of the supply integration channel 10 and the return integration channel 11 can be increased. By increasing the flow rate of the liquid in the supply integration channel 10 and the return integration channel 11 in such a manner, the increase and decrease in the temperature of the liquid are suppressed. Accordingly, it is possible to make the difference between a high temperature and a low temperature of the liquid be small. Thus, the levelling in the temperature in the entire liquid is promoted, thereby making it possible to further enhance the heat uniformizing effect for the liquid. Further, by increasing the flow rate of the liquid in each of the supply integration channel 10 and the return integration channel 11, an effect of removing any air bubble in the liquid is also promoted.

Furthermore, in the present embodiment, the supply integration channel 10 extends from the left end toward the inner side in the head longitudinal direction as depicted in FIG. 3, and the supply port 52 is arranged so that the supply port 52 overlaps with the pressure chamber-arranging area PR in the plan view; further, the return integration channel 11 extends from the right end toward the inner side in the head longitudinal direction as depicted in FIG. 4, and the return port 55 is arranged so that the return port 55 overlaps with the pressure chamber-arranging area PR in the plan view. Owing to such a configuration, it is possible to miniaturize the liquid discharging head 100 further in the head longitudinal direction.

Second Embodiment

Next, an explanation will be given about a liquid discharging head 100A according to a second embodiment of the present disclosure.

The difference between the configuration of the liquid discharging head 100A of the second embodiment and the configuration of the liquid discharging head 100 of the above-descried first embodiment is the position in the width direction of the supply port (supply integration channel), and the position in the width direction of the return port (return integration channel). In the following, the difference will be explained in detail. Note that since the cross-sectional configuration in FIG. 5, which will be explained as follows, is a modification of the cross-sectional configuration of FIG. 3 as described above, a part or portion overlapping with the content explained regarding FIG. 3 will be omitted, except for a part thereof.

Figure 5:
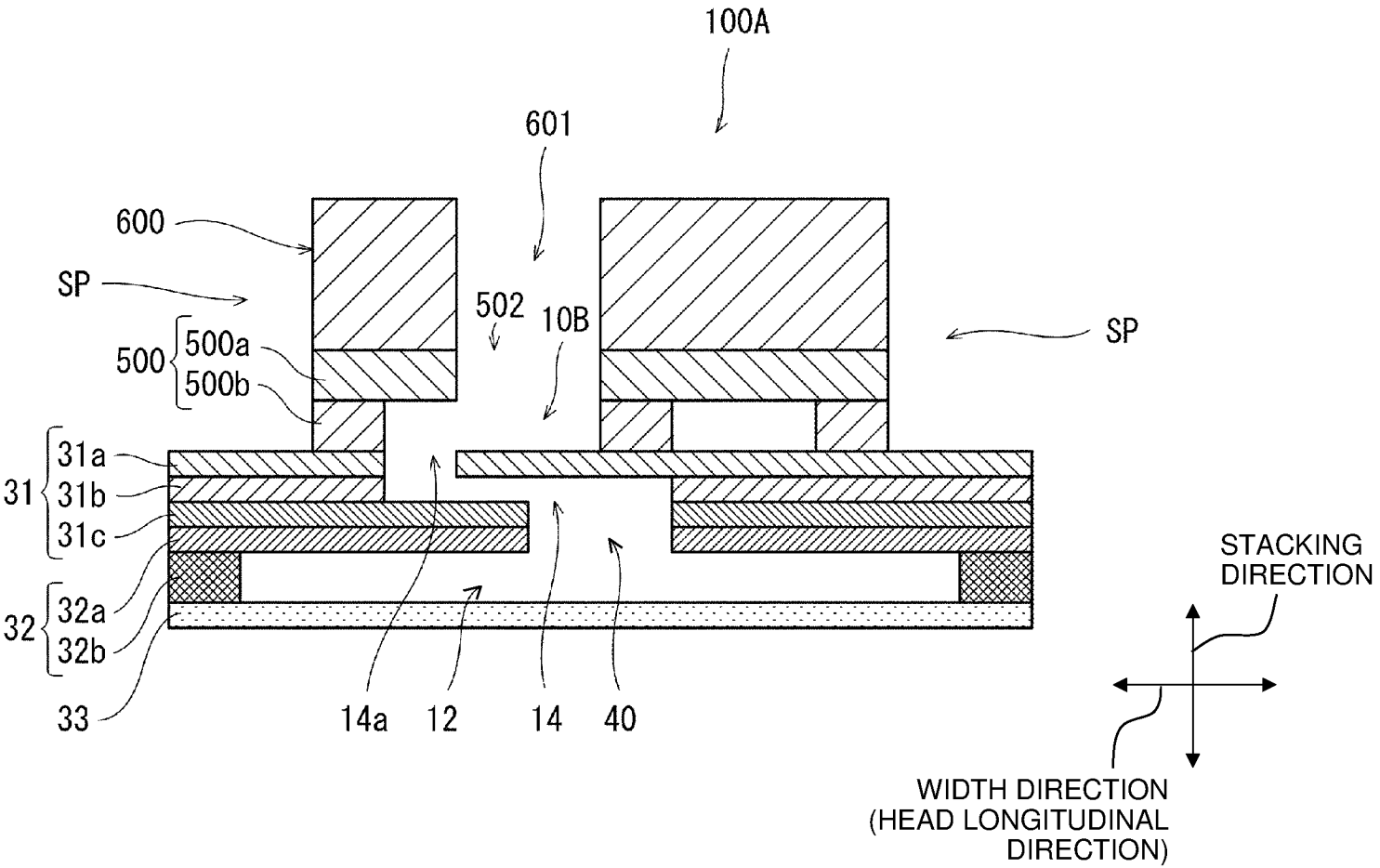
FIG. 5 is a cross-sectional view, depicting a liquid discharging head according to a second embodiment, which is a modification of the cross-sectional view of the liquid discharging head depicted in FIG. 3.

As depicted in FIG. 5, the width of a sub housing plate 600 in the second embodiment is made to be shorter than the width of the interposer plate 31, the width of the manifold plate 32 and the width of the nozzle plate 33. Further, the sub housing plate 600 is arranged so that the center in the width direction of the interposer plate 31 and the center in the width direction of the sub housing plate 600 are substantially coincident (match) with each other. With this, spaces SP are defined, respectively, at locations above both end parts in the width direction of the third channel plate 31*a* of the interposer plate 31.

A through hole 601 is formed in the sub housing plate 600. The through hole 601 is arranged substantially at the center in the width direction of the supply manifold 12. Further, the through hole 601 is located at a position above a through hole, of a sixth channel plate 500*a* (to be described later on), which constructs a part of a supply integration channel 10B. Accordingly, the through hole 601 in the sub housing plate 600 is connected to an inlet port 502 of the supply integration channel 10B described later. Further, the width of the through hole 601 is substantially same as the width of the through hole in the sixth channel plate 500*a*.

A reservoir plate 500 includes a sixth channel plate 500*a* and a seventh channel plate 500*b* each of which has a through hole formed therein. The supply integration channel 10B is constructed by combining the through holes formed in the sixth channel plate 500*a* and the seventh channel plate 500*b*, respectively. Specifically, an opening on the upper side in the through hole in the sixth channel plate 500*a* becomes to be a supply port 502. Also in the second embodiment, the supply port 502 is arranged such that at least a part of the supply port 502 overlaps with the inner side of the pressure chamber-arranging area PR. As depicted in FIG. 5, the supply port 502 is arranged to be separated, in the width direction, with respect to the interposer channel-inlet port 14*a*. In particular, in the second embodiment, the supply port 502 is arranged at the center in the width direction of the supply manifold 12. Further, the supply port 502 is arranged on the inner side of the liquid discharging head 100A in the width direction of the supply manifold 12, with respect to the interposer channel-inlet port 14*a*.

The through hole in the seventh channel plate 500*b* is constructed of a first part formed below the through hole in the sixth channel plate 500*a*, and a second part which is formed on the left side of the first part. The width of the first part in the seventh channel plate 500*b* is substantially same as the width of the through hole in the sixth channel plate 500*a*. Such first and second parts in the seventh channel plate 500*b* and the through hole in the sixth channel plate 500*a* are combined to thereby form the supply integration channel 10B.

Next, a return port and a return integration channel in the second embodiment will be explained. Note that since the cross-sectional configuration in FIG. 6, which will be explained as follows, is a modification of the cross-sectional configuration of FIG. 4 as described above, a part or portion overlapping with the content explained regarding FIG. 4 will be omitted, except for a part thereof.

Figure 6:
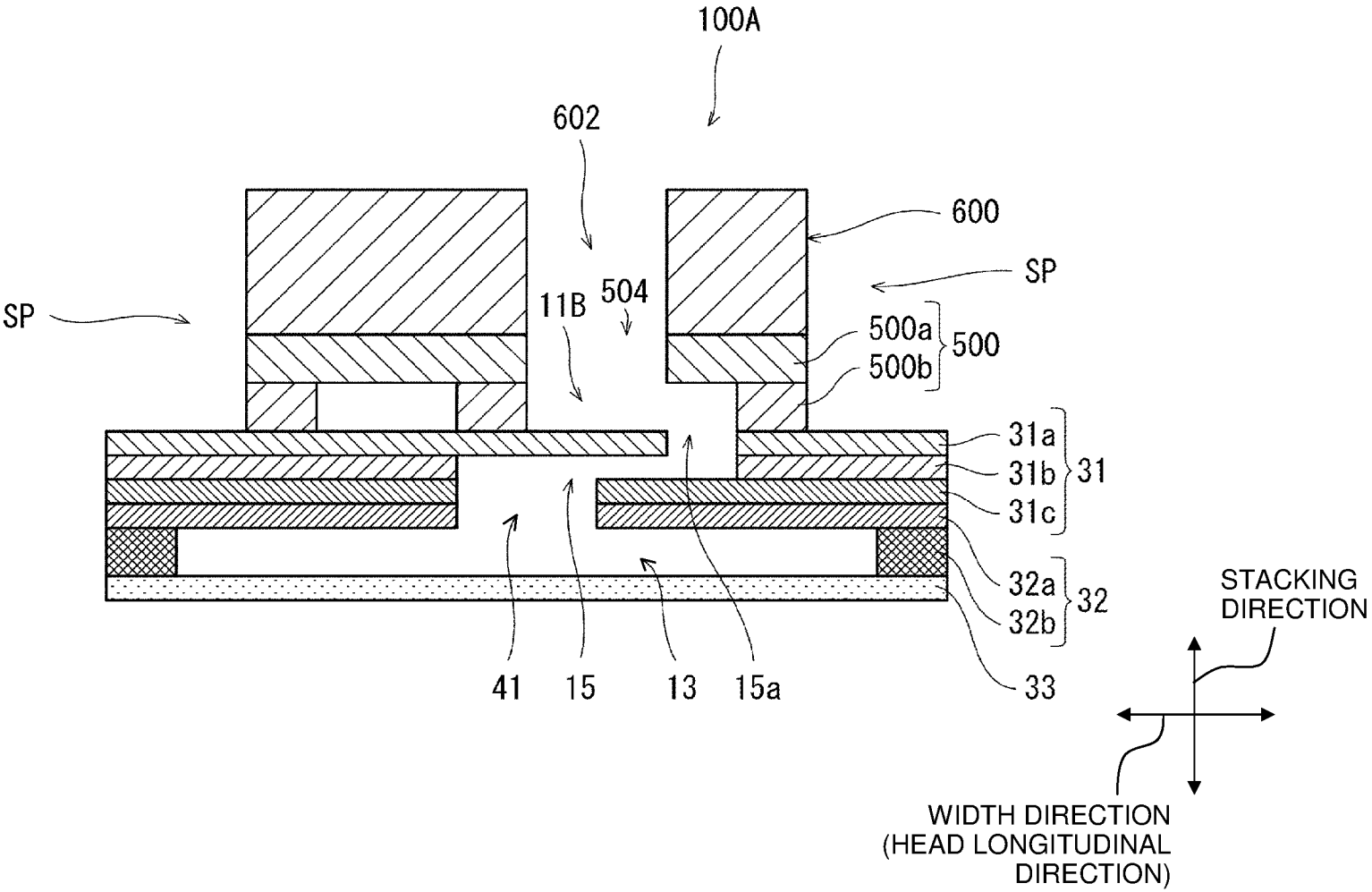
FIG. 6 is a cross-sectional view, depicting the liquid discharging head according to the second embodiment, which is a modification of the cross-sectional view of the liquid discharging head depicted in FIG. 4.

As depicted in FIG. 6, a through hole 602, which is different from the above-described through hole 601, is formed in the sub housing plate 600. The through hole 602 is arranged substantially at the center in the width direction of the supply manifold 12 and the return manifold 13. Further, the through hole 602 is located at a position above a through hole, of the sixth channel plate 500*a*, which constructs a part of a return integration channel 11B. Accordingly, the through hole 602 in the sub housing plate 600 is connected to a return port 504 (to be described later on) of the return integration channel 11B. Further, the width of the through hole 602 is substantially same as the width of the through hole in the sixth channel plate 500*a*.

The return integration channel 11B is constructed by combining the through hole formed in the sixth channel plate 500*a* and a through hole formed in the seventh channel plate 500*b*. Specifically, an opening on the upper side in the through hole in the sixth channel plate 500*a* becomes to be the return port 504. Also in the second embodiment, the return port 504 is arranged so that at least a part of the return port 504 overlaps with the inner side of the pressure chamber-arranging area PR. As depicted in FIG. 6, the return port 504 is arranged to be separated, in the width direction, with respect to the outlet port 15*a* of the interposer channel 15. In particular, in the second embodiment, the return port 504 is arranged at the center in the width direction of the return manifold 13. Further, in the second embodiment, the return port 504 is arranged on the inner side in the width direction of the supply manifold 12 and the return manifold 13, with respect to the outlet port 15*a* of the interposer channel 15*a*.

Further, the through hole in the seventh channel plate 500*b* is constructed of a first part formed below the through hole in the sixth channel plate 500*a*, and a second part which is formed on the right side of the first part. Furthermore, the width of the first part in the seventh channel plate 500*b* is substantially same as the width of the through hole in the sixth channel plate 500*a*. Such first and second parts in the seventh channel plate 500*b* and the through hole in the sixth channel plate 500*a* are combined to thereby form the return integration channel 11B.

As explained above, also in the liquid discharging head 100A of the second embodiment, the supply port 502 is arranged so that at least a part of the supply port 502 overlaps, in the plan view, with the inner side of the pressure chamber-arranging area PR. Further, the return port 504 is arranged so that at least a part of the return port 504 overlaps, in the plan view, with the inner side of the pressure chamber-arranging area PR. With such a configuration, it is possible to miniaturize the liquid discharging head 100A in both of the arrangement direction and the width direction which is a direction crossing the arrangement direction, also in the liquid discharging head 100A of the second embodiment. Further, since each of the supply integration channel 10B and the return integration channel 11B extends in the arrangement direction in the non-bent state, it is possible to shorten the channel length of each of the supply integration channel 10B and the return integration channel 11B, and thus to lower the channel resistance in each of the supply integration channel 10B and the return integration channel 11B. Further, also in the liquid discharging head 100A of the second embodiment, it is possible to lower any disturbance in printing due to any error in conveyance, in a similar manner in the first embodiment.

Further, in the second embodiment, the supply port 502 is arranged at the center in the width direction of the supply manifold 12, and the return port 504 is arranged at the center in the width direction of the return manifold 13. With such a configuration, in a case that the supplying joint and the returning joint are arranged, the supplying joint and the returning joint can be arranged in the width direction in a compact manner. With this, the miniaturization of the liquid discharging head 100A can be more promoted.

Moreover, in the second embodiment, the supply port 502 is arranged on the inner side of the liquid discharging head 100A in the width direction of the supply manifold 12, in the plane view, with respect to the interposer channel-inlet port 14*a*, and the spaces SP are formed respectively at the both end parts in the width direction of the third channel plate 31*a* of the interposer plate 31. Owing to such a configuration, in a case that a wiring for applying voltage to a driving element which drives the pressure chamber P is to be drawn to the outside of the liquid discharging head 100A, such wiring can be arranged in the space(s) SP, and thus there is not any interference from the wiring and without any hindrance.

Other Embodiments

The present invention is not limited to or restricted by the above-described embodiments, and a variety of kinds of change or modification can be made within a range not departing from the gist and spirit of the present invention, as exemplified, for example, as follows.

In the second embodiment as described above, the supply port 502 is arranged so that the entirety of the supply port 502 overlaps with the inner side in the width direction of the supply manifold 12 in the plan view, and the return port 504 is arranged so that the entirety of the return port 504 overlaps with the inner side in the width direction of the return manifold 13 in the plan view. There is no limitation thereto. For example, it is allowable to arrange the supply port 502 so that at least a part of the supply port 502 overlaps with the inner side in the width direction of the supply manifold 12 in the plan view, and to arrange the return port 504 so that at least a part of the return port 504 overlaps with the inner side in the width direction of the return manifold 13 in the plan view. Also with such a configuration, it is possible to obtain a liquid discharging apparatus which is miniaturized than the conventional counterparts.

Further, the above-described embodiments each has the configuration wherein the one end of the supply integration channel 10 and the one end of the return integration channel 11 are connected by the first bypass channel 21, and the other end of the supply integration channel 10 and the other end of the return integration channel 11 are connected by the second bypass channel 22. Other than this, however, it is also allowable that a part, of the supply integration channel 10, which is located at a position between one supply-return combination MK and the other supply-return combination MK of two adjacent supply-return combinations MK, and a part, of the return integration channel 11, which is located at a same position as such part of the supply integration channel 10, are connected to each other by a bypass channel.

Furthermore, in the above-described embodiments, the channel width of the interposer channel 14 is made greater than the channel width of the supply manifold 12, and the channel width of the interposer channel 15 is made greater than the channel width of the return manifold 13. The present disclosure, however, is not limited to or restricted by this. For example, it is allowable to make the channel width of the interposer channel 14 to be smaller than or same as the channel width of the supply manifold 12, and to make the channel width of the interposer channel 15 to be smaller than or same as the channel width of the return manifold 13.

What is claimed is:

1. A liquid discharging head comprising:

a plurality of supply manifolds configured to receive a liquid to be discharged from a plurality of nozzles, the plurality of supply manifolds being arranged side by side with each other;

a supply integration channel which extends linearly along an arrangement direction crossing a longitudinal direction of the plurality of supply manifolds, and which is configured to supply the liquid to each of the plurality of supply manifolds;

a plurality of return manifolds which extends in the longitudinal direction of the plurality of supply manifolds, and which is configured to receive the liquid not having been discharged from the plurality of nozzles;

a connecting channel connecting the supply integration channel and one supply manifold of the plurality of supply manifolds, the connecting channel having a connecting channel-inlet which is an opening arranged at a lower side of the supply integration channel; and a return integration channel which extends linearly along the arrangement direction, and which is configured to receive the liquid from each of the plurality of return manifolds, wherein the supply integration channel has a supply port separated from the connection channel-inlet, in a plan view, and arranged, apart from each of the plurality of supply manifolds, at an upper side of the supply integration channel, the supply port being configured to supply the liquid to the supply integration channel via the supply port, and at least a part of the supply port being overlapped, in the plan view, with a pressure chamber-arranging area as an area in which each of a plurality of pressure chambers communicating with each of the plurality of nozzles is arranged; and the return integration channel has a return port arranged, apart from each of the plurality of return manifolds, at an upper side of the return integration channel, the return port being configured to drain the liquid from the return integration channel via the return port, and at least a part of the return port being overlapped, in the plan view, with the pressure chamber-arranging area.

2. The liquid discharging head according to claim 1, wherein the supply port is arranged at a center in a longitudinal direction of the supply integration channel, and the return port is arranged at a center in a longitudinal direction of the return integration channel.

3. The liquid discharging head according to claim 1, wherein the supply port is arranged at one end in a longitudinal direction of the supply integration channel, and the return port is arranged at one end in a longitudinal direction of the return integration channel, the one end of the return integration channel being positioned, in the arrangement direction along the longitudinal directions of the supply and return integration channels, at a side opposite to a side at which the one end of the supply integration channel is positioned.

4. The liquid discharging head according to claim 1, wherein the supply port is arranged on an inner side of the liquid discharge head with respect to the connection channel-inlet in the longitudinal direction of the plurality of supply manifolds.

5. The liquid discharging head according to claim 1, wherein the supply port is arranged on an outer side of the liquid discharge head with respect to the connection channel-inlet in the longitudinal direction of the plurality of supply manifolds.

6. The liquid discharging head according to claim 1, wherein the supply port and the return port are separated from each other in the arrangement direction.

7. The liquid discharging head according to claim 1, further comprising:

a first bypass channel communicating a first end of the supply integration channel and a first end of the return integration channel; and a second bypass channel communicating a second end of the supply integration channel and a second end of the return integration channel.

8. The liquid discharging head according to claim 1, wherein the supply integration channel extends in a head longitudinal direction crossing the arrangement direction, and the supply port is arranged so as to overlap, in the plan view, with the pressure chamber-arranging area extending in the head longitudinal direction; and the return integration channel extends in the head longitudinal direction, and the return port is arranged so as to overlap, in the plan view, with the pressure chamber-arranging area extending in the head longitudinal direction.

* * * * *